United States Patent [19]

Ogasawara et al.

[11] Patent Number: 4,907,833

[45] Date of Patent: Mar. 13, 1990

[54] OUTSIDE HANDLE DEVICE FOR USE IN A VEHICLE

[75] Inventors: Shinji Ogasawara, Hekinan; Yukio Isomura, Chiryu; Tetsurou Tanimoto, Kariya, all of Japan

[73] Assignee: Aisin Seiki Kabushiki Kaisha, Kariya, Japan

[21] Appl. No.: 289,382

[22] Filed: Dec. 23, 1988

[30] Foreign Application Priority Data

Dec. 24, 1987 [JP] Japan ..... 62-196465[U]

[51] Int. Cl.[4] ..... E05B 3/00

[52] U.S. Cl. ..... 292/336.3; 292/DIG. 61

[58] Field of Search ..... 292/336.3, 347, DIG. 61, 292/DIG. 31; 16/112, 110 R

[56] References Cited

U.S. PATENT DOCUMENTS 4,475,754 10/1984 Arlauskas et al. ..... 292/336.3

*Primary Examiner*—Nicholas P. Godici

*Assistant Examiner*—Carmine Cuda

*Attorney, Agent, or Firm*—Oblon, Spivak, McClelland, Maier & Neustadt

[57] ABSTRACT

An outside handle device has a stationary base to which a handle is pivotably mounted. A bell-crank operatively connected to a door latching mechanism is also pivotably mounted to the base. A common spring has ends connected to both the handle and the bell-crank for urging both to initial positions thereof. The common spring permits the simultaneous return of both the handle and the bell-crank to their initial positions, so that noise generation is avoided.

6 Claims, 1 Drawing Sheet.

OUTSIDE HANDLE DEVICE FOR USE IN A VEHICLE

BACKGROUND OF THE INVENTION

1. Field of the Invention

The present invention relates to an outside handle device for use in a vehicle, and in particular to an outside handle device which serves for unlatching the door mechanism of a vehicle from outside of the body of the vehicle.

2. Description of the Related Art

A conventional outside handle device of this kind, as shown in FIG. 3, is fixed to a door and includes a base 1 to which a handle 3 is pivotably mounted via a pin 2. Upon manipulation or operation of the handle 3, a lever portion 3*a* of the handle 3 is brought into engagement with one end 5*a* of a bell-crank 5 which is pivoted to the base 1 via a pin 4. Due to the resulting rotation of the bell-crank, a door-latch mechanism (not shown), which is operatively connected to the other end 5*b* of the bell-crank 5, is operated.

On the pin 2 and the pin 4, there are provided a spring 6 and a spring 7, respectively. One end and the other end of the spring 6 are respectively engaged with the base 1 and the handle 3. One end and the other end of the spring 7 are respectively engaged with the pin 4 and the bell-crank 5. After manipulation of the handle 3, the handle 3 and the bell-crank 5 are returned to their original positions by the restoration forces of the springs 6 and 7, respectively.

However, due to differences in the loads acting on the spring 6 and the spring 7, the returning movements of the handle 3 and the bell-crank 5 are not completed simultaneously; the handle 3 returns to its initial position more rapidly than does the bell-crank 5. Thus, a noise is generated as a result of a collision of the handle portion 3*a* of the handle 3 with the one end 5*a* of the bell-crank 5.

SUMMARY OF THE INVENTION

It is, therefore, a principal object of the present invention to provide an outside door handle without the aforementioned drawback.

Another object of the present invention is to provide an outside door handle in which a handle and a bell-crank may be simultaneously returned to their original positions.

To achieve these objects, and in accordance with the purposes of the present invention, an outside handle device for use in a vehicle is comprised of a stationary base, a handle pivotably mounted on the base, a spring provided on the handle and having one end urging the handle to its initial position, and a bell-crank operatively connected to a door-latching mechanism and engaged with the other end of the spring so as to be urged to its initial position.

BRIEF DESCRIPTION OF THE DRAWINGS

The above and other objects, features and advantages of the present invention will become apparent and more readily appreciated from the following detailed description of preferred exemplary embodiments of the present invention, taken in connection with the accompanying drawings, in which.

DETAILED DESCRIPTION OF THE PREFERRED EMBODIMENT

Figure 1:
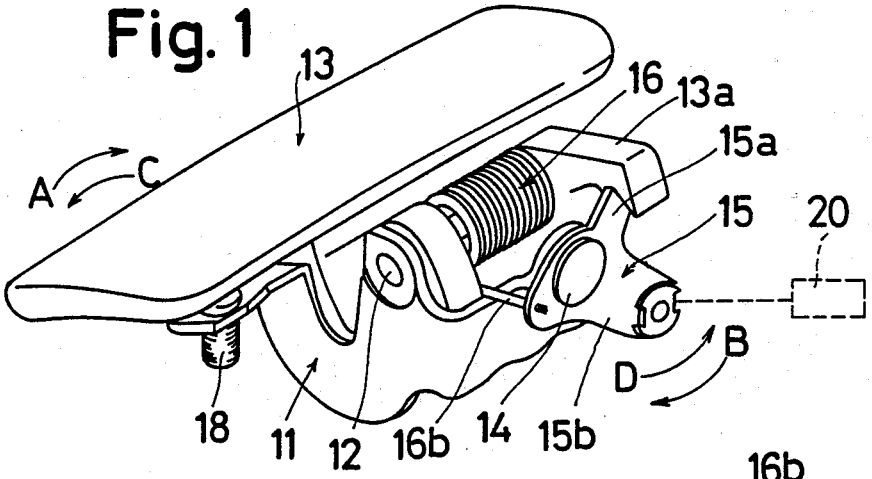
FIG. 1 is a perspective view of an outside door handle device according to the present invention.
Figure 2:
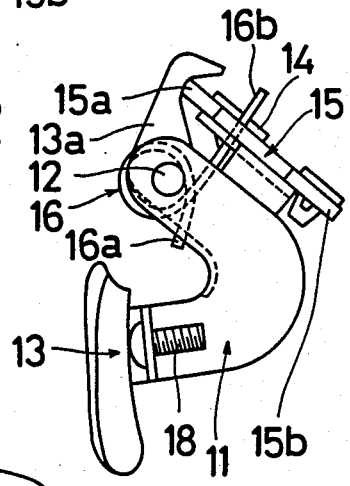
FIG. 2 is a side view of the outside door handle device in FIG. 1.
Figure 3:
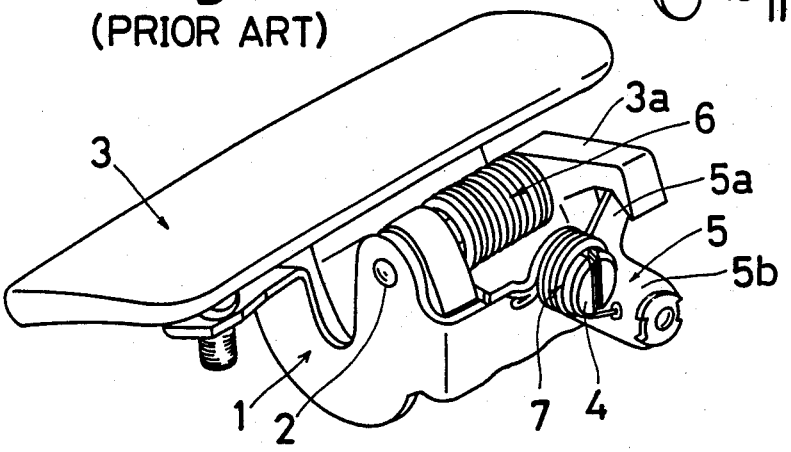
Fig. 3 (PRIOR ART)
FIG. 3 is a perspective view of a conventional outside handle device.

Referring now to FIGS. 1 and 2, a handle 13 is pivotably mounted on a stationary base 11 mounted to a vehicle door (not shown), via a pin 12. A bell-crank 15 is also pivotably mounted to the base 11 via pin 14. The handle 13 includes a lever portion 13*a* which is initially engaged with one end 15*a* of the bell-crank 15. The other end 15*b* of the bell-crank 15 is operatively connected to a door-latching mechanism 20 for latching or unlatching the door, which is of wellknown construction. In the condition shown in FIGS. 1 and 2, the door-latching mechanism 20 latches the door.

On the pin 12, there is provided a torsion spring 16. One end 16*a* and the other end 16*b* of the spring 16 are respectively engaged with the handle 13 and the bell-crank 15. Due to the load of the spring 16, the handle 13 is urged in the direction C so as to be placed in the illustrated initial position thereof, and the bell-crank 15 is urged in the direction of D so as to be placed in the illustrated initial position thereof. In the base 11, a stopper 28 in the form of a bolt is threadably driven and is in abutment with the handle 13 in its initial position. Thus, the initial position of the handle 15 may be adjusted to some extent.

In operation, when the handle 13 is rotated in the direction A against the load of the torsion spring 16, the bell-crank, whose one end 15*a* is in engagement with the lever portion 13*a* of the handle 13 is rotated in the direction of B against the load of the torsion spring 16. As a result of the rotation of the bell-crank 15, the door-latching mechanism 20 is brought into an unlatched condition, thereby enabling the opening of the door. Thereafter, when the handle 13 is released, restorational forces generated at one end 16*a* and the other end 16*b* of the spring 16 rotate the handle 13 in the direction of C and rotate the bell-crank 15 in the direction of D to return to their initial positions.

As is apparent from the above-description, in the present invention, the returning movement of the handle 13 and the returning movement of the bell-crank 15 are performed by the common spring 16, thereby avoiding a collision therebetween.

While the invention has been particularly shown and described with reference to preferred embodiments thereof, it will be understood that those skilled in the art that the foregoing and other changes in form and details can be made therein without departing from the spirit and scope of the invention.

WHAT IS CLAIMED AS NEW AND DESIRED TO BE SECURED BY LETTERS PATENT OF THE UNITED STATES IS:

1. An outside handle device for use with a vehicle, comprising:

a stationary base;

a handle pivotably mounted on said base;

a spring provided on said handle and having one end engaging said handle and urging said handle to an initial position thereof; and a bell-crank operatively connected to a door latching mechanism and engaged with the other end of said spring, said other end of said spring urging said bell-crank to an initial position thereof.

2. An outside handle device according to claim 1 wherein said handle includes a portion engaging said bell-crank and operative to move said bell-crank away from said initial position thereof when said handle is moved away from said initial position thereof, whereby said spring urges said handle and said bell-crank to return to said respective initial positions thereof.

3. An outside handle device according to claim 2 wherein said bell-crank is pivotally mounted to said base.

4. An outside handle device according to claim 2, including stopper means provided to said base for defining said initial position of said handle.

5. An outside handle device for use in a vehicle according to claim 4 wherein said stopper is threadably mounted to said base.

6. An outside handle device according to claim 2 in combination with a vehicle having a door latching mechanism, wherein said bell-crank operates said door latching mechanism when said bell crank is moved away from said initial position thereof.

* * * * *